US006622606B1

(12) United States Patent
Neal

(10) Patent No.: US 6,622,606 B1
(45) Date of Patent: Sep. 23, 2003

(54) WEAPON SYSTEM AMMUNITION FEED ASSEMBLY

(76) Inventor: Ken Neal, 2620 Old Big Cove Rd., Owens Crossroads, AL (US) 35763

( * ) Notice: Subject to any disclaimer, the term of this patent is extended or adjusted under 35 U.S.C. 154(b) by 0 days.

(21) Appl. No.: 09/961,225

(22) Filed: Sep. 21, 2001

(51) Int. Cl.[7] ..... F41A 9/00
(52) U.S. Cl. ..... 89/33.01; 89/34; 42/90
(58) Field of Search ..... 89/33.01, 34; 42/90, 42/98

(56) References Cited

U.S. PATENT DOCUMENTS

| | | | | | |
|---|---|---|---|---|---|
| 386,535 | A | | 7/1888 | Graham | |
| 1,719,147 | A | * | 7/1929 | Tansley | 89/33.14 |
| 2,024,125 | A | | 12/1935 | Bochnak | 89/9 |
| 2,354,277 | A | * | 7/1944 | Richardson | 42/98 |
| 2,359,263 | A | * | 9/1944 | Webb | 89/33.14 |
| 2,381,959 | A | * | 8/1945 | Ironside | 89/34 |
| 2,418,428 | A | * | 4/1947 | Rundquist | 89/33.2 |
| 2,484,104 | A | * | 10/1949 | Lippert | 89/33.16 |
| 2,573,749 | A | | 11/1951 | Wheeler et al. | 89/33 |
| 2,830,498 | A | | 4/1958 | Maillard | 89/33 |
| 2,895,382 | A | * | 7/1959 | Starry | 89/34 |
| 3,035,495 | A | * | 5/1962 | Stoner | 89/33.2 |
| 3,246,565 | A | | 4/1966 | Ramseyer | 89/33 |
| 3,467,276 | A | | 9/1969 | Dardick | 221/260 |
| 3,540,345 | A | | 11/1970 | Wolfe | 89/13 |
| 4,112,817 | A | | 9/1978 | Bourlet | 89/33 |
| 4,115,943 | A | * | 9/1978 | Musgrave | 42/90 |
| 4,392,407 | A | | 7/1983 | LaFever et al. | 89/33 |
| 4,753,155 | A | | 6/1988 | Balister | 89/34 |
| 4,951,548 | A | | 8/1990 | Wixon et al. | 89/33 |
| 4,972,758 | A | | 11/1990 | Austin et al. | 89/34 |
| 5,282,410 | A | | 2/1994 | Sanderson | 89/37 |
| 5,419,234 | A | | 5/1995 | Sanderson | 89/37 |
| 5,636,465 | A | * | 6/1997 | Johnson | 42/90 |
| 5,782,157 | A | | 7/1998 | Ellington et al. | 89/33 |
| 5,806,224 | A | * | 9/1998 | Hager | 42/18 |
| 5,905,224 | A | | 5/1999 | Jordan | 89/33 |
| 6,173,520 | B1 | * | 1/2001 | Bucciarelli et al. | 42/98 |
| 6,393,960 | B1 | * | 5/2002 | Bilger | 89/37.03 |

* cited by examiner

*Primary Examiner*—Michael J. Carone
*Assistant Examiner*—M. Thomson
(74) *Attorney, Agent, or Firm*—Waddey & Patterson; Larry W. Brantley

(57) ABSTRACT

An ammunition feed assembly for a military weapon system includes a feed chute housing and an ammunition support bracket for supporting ammunition adjacent to the feed chute housing. The feed chute housing is adapted to be connected to an ammunition guide for a weapon mounted on the weapon system and includes a flanged portion for guiding ammunition into the chute housing. The ammunition support bracket is adapted to be connected to the weapon system and includes a support portion for supporting ammunition adjacent to the feed chute housing. Ammunition is fed from the ammunition box, through the feed chute housing and the ammunition guide, and into the weapon mounted on the weapon system.

13 Claims, 14 Drawing Sheets

WEAPON SYSTEM AMMUNITION FEED ASSEMBLY

BACKGROUND OF THE INVENTION

The present invention relates generally to ammunition feed assemblies. More particularly, this invention pertains to an ammunition feed assembly for a military weapon system.

Ammunition feed assemblies for military weapon systems are known in the art. For example, the Avenger weapon system, which is a United States military weapon system, includes a 0.50 caliber machine gun and an ammunition feed assembly for supplying ammunition to the gun (see FIG. 1). The Avenger ammunition feed assembly includes a guide connected to the weapon system adjacent to the machine gun for guiding ammunition into the machine gun and a flexible feed chute connected between the guide and an ammunition box mounted on the side of the weapon system for guiding ammunition from the ammunition box to the guide. Similar ammunition feed assemblies are also used with other military weapon systems as well.

The Avenger ammunition feed assembly shown in FIG. 1, however, frequently jams when ammunition is being fed from the ammunition box to the 0.50 caliber machine gun. To unjam the weapon, a soldier must exit the vehicle and physically remove the jam, which takes time and exposes the soldier to the danger of a potentially serious injury or death when the jam occurs during actual combat.

What is needed, then, is an ammunition feed assembly that does not jam or, alternatively, at least jams less frequently than existing prior art ammunition feed assemblies used with the Avenger or other similar military weapon systems.

SUMMARY OF THE INVENTION

Accordingly, one object of the present invention is to provide an ammunition feed assembly that does not jam or, alternatively, at least jams less frequently than the current ammunition feed assemblies used with the Avenger and other similar military weapon systems.

Another object is to provide an ammunition feed assembly that can be retrofitted onto existing military weapon systems.

Still another object of the present invention is to provide a method of replacing an existing ammunition feed assembly on a weapon system with the ammunition feed assembly of the present invention.

These and other objects, which will become apparent to a person practicing the present invention, are satisfied by an ammunition feed assembly for a military weapon system having a weapon that includes an ammunition feed chute and an ammunition support bracket. The ammunition feed chute includes a connection mechanism on one end for connecting the feed chute to the weapon system and a flanged opening on the other end for guiding ammunition into the chute. The ammunition support bracket includes a mounting portion for connecting the ammunition support bracket to the weapon system and a support portion for supporting an ammunition box adjacent to the feed chute. Ammunition is fed out of the ammunition box, through the feed chute and guide, and into the weapon.

In one embodiment, adapted for use with an Avenger weapon system, the ammunition feed chute is a rectangular-shaped hollow structure with a flanged opening on one end. The other end of the feed chute includes a pair of openings for removably connecting the feed chute to the existing guide of the Avenger weapon system using quick release pins. The mounting portion of the ammunition support bracket includes a flat rectangular structure with a pair of arms on both ends. The arms include mounting openings, which are used to connect the mounting portion to an existing brass catcher on the Avenger weapon system so that the support portion is adjacent to the feed chute. The support portion includes an open front end formed by a flat base connected to two side walls, which are all, in turn, connected to a back wall. The back wall is used to prevent an ammunition box inserted into the support portion through the open front end from sliding out of the back of the support portion. The side walls include a series of mounting openings along a top portion of each side wall and are connected to the rectangular flat structure of the mounting portion using the side wall mounting openings. The portions of the side walls that form the open front end include a pair of openings for receiving a quick release pin, which is used to prevent an ammunition box inserted into the support portion from sliding out of the support portion.

This embodiment of the present invention is connected to an Avenger weapon system by removing the existing ammunition feed assembly and connecting the feed assembly of the present invention to the weapon system. The existing ammunition feed assembly is removed by disconnecting the flexible feed chute from the existing guide and ammunition box on the weapon system and disconnecting the brass catcher from the weapon system. The feed assembly of the present invention is installed by connecting the feed chute to the guide using quick release pins and connecting the combination of the ammunition support bracket and the brass catcher to the weapon system.

DESCRIPTION OF THE PREFERRED EMBODIMENTS

Figure 2:
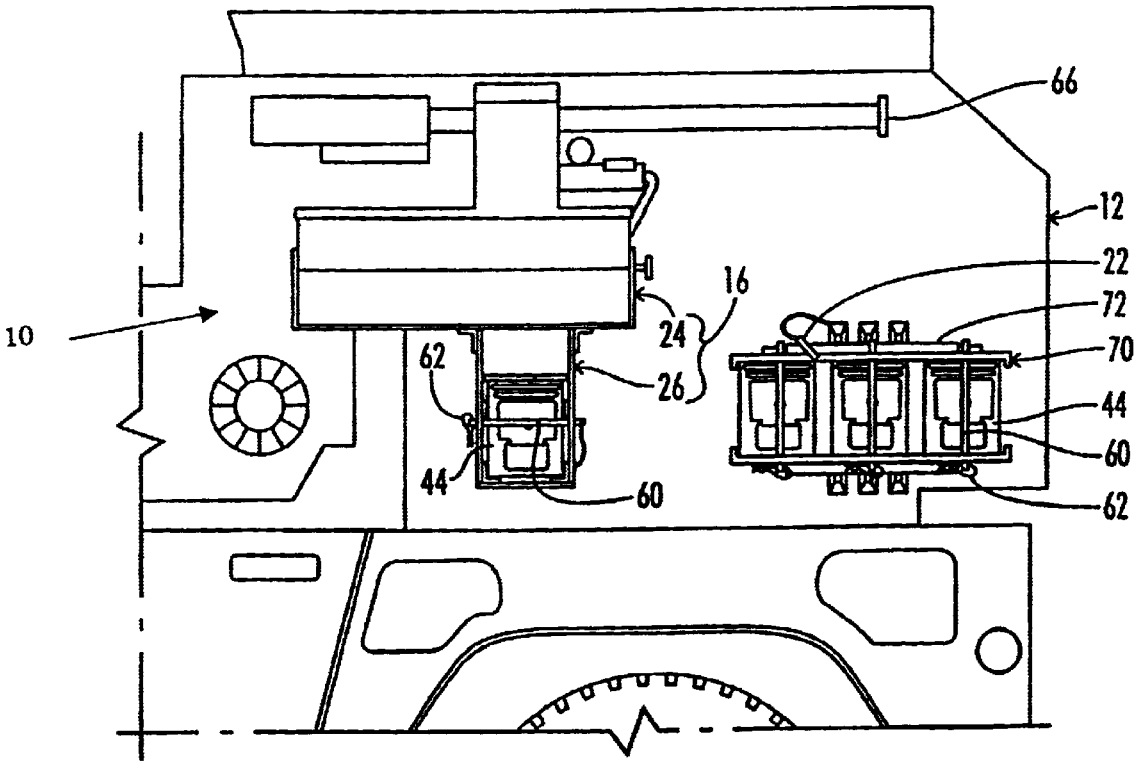
FIG. 2 is side view of one embodiment of the present invention of an ammunition feed assembly.
Figure 3:
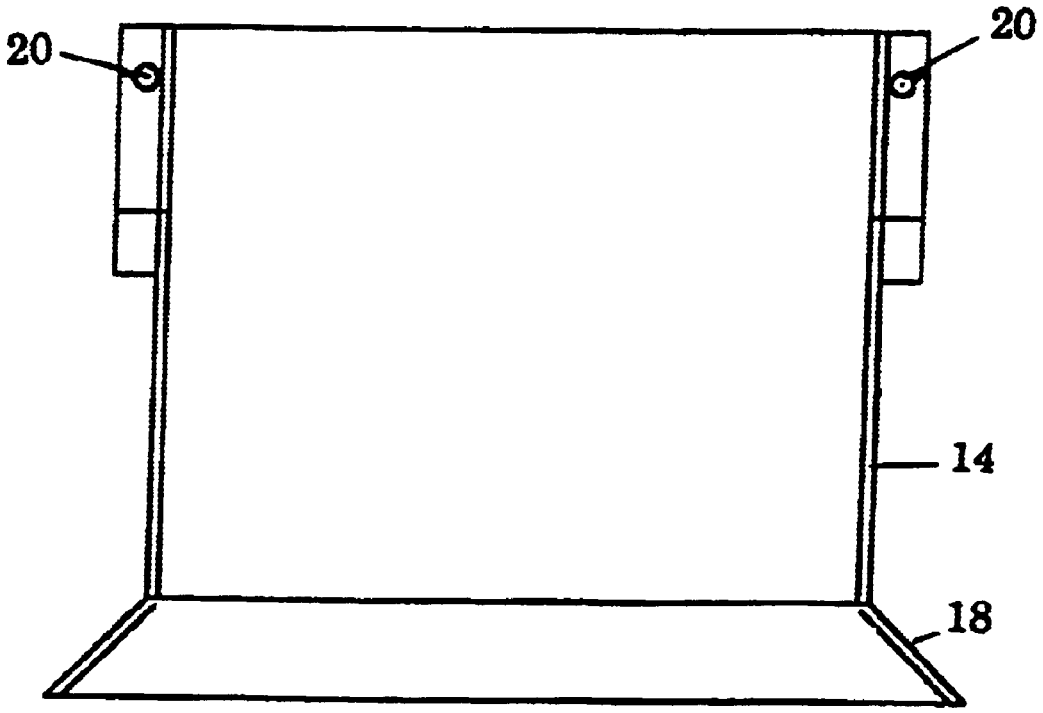
FIG. 3 is a front view of one embodiment of the feed chute housing of the present invention.
Figure 4:
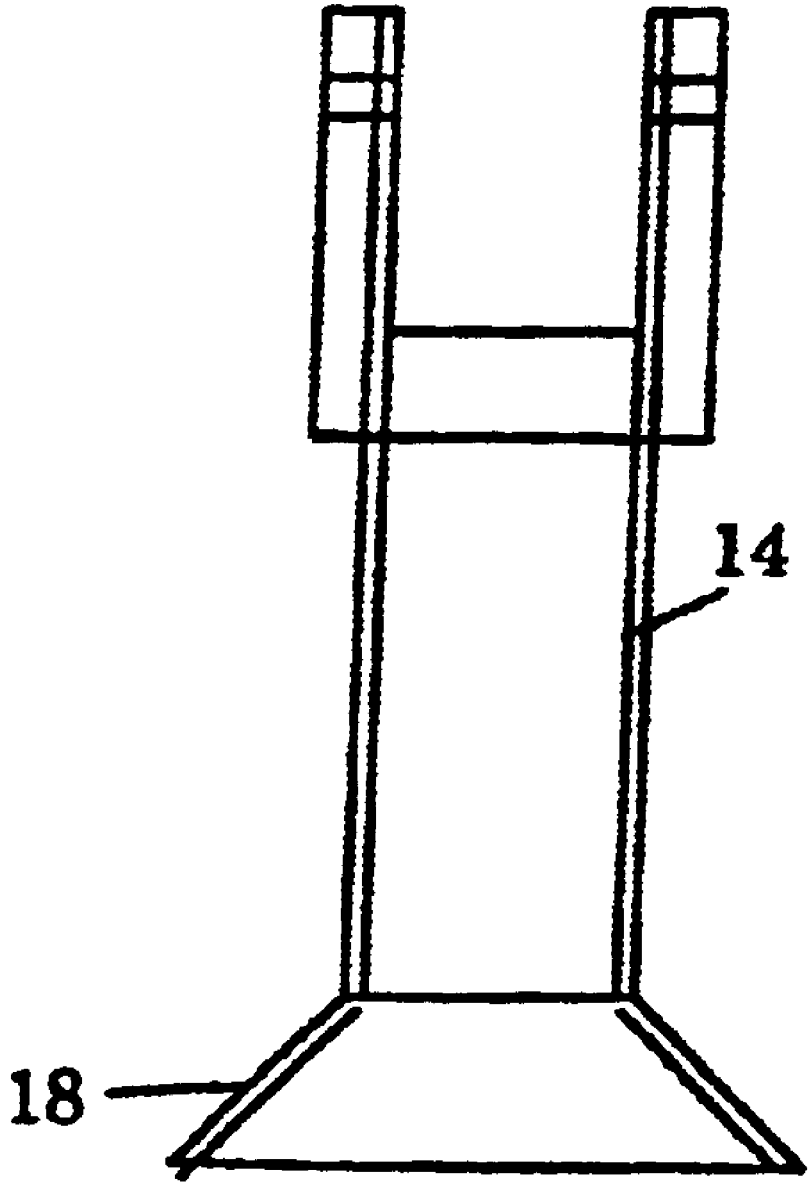
FIG. 4 is a side view of one embodiment of the feed chute housing of the present invention.
Figure 5:
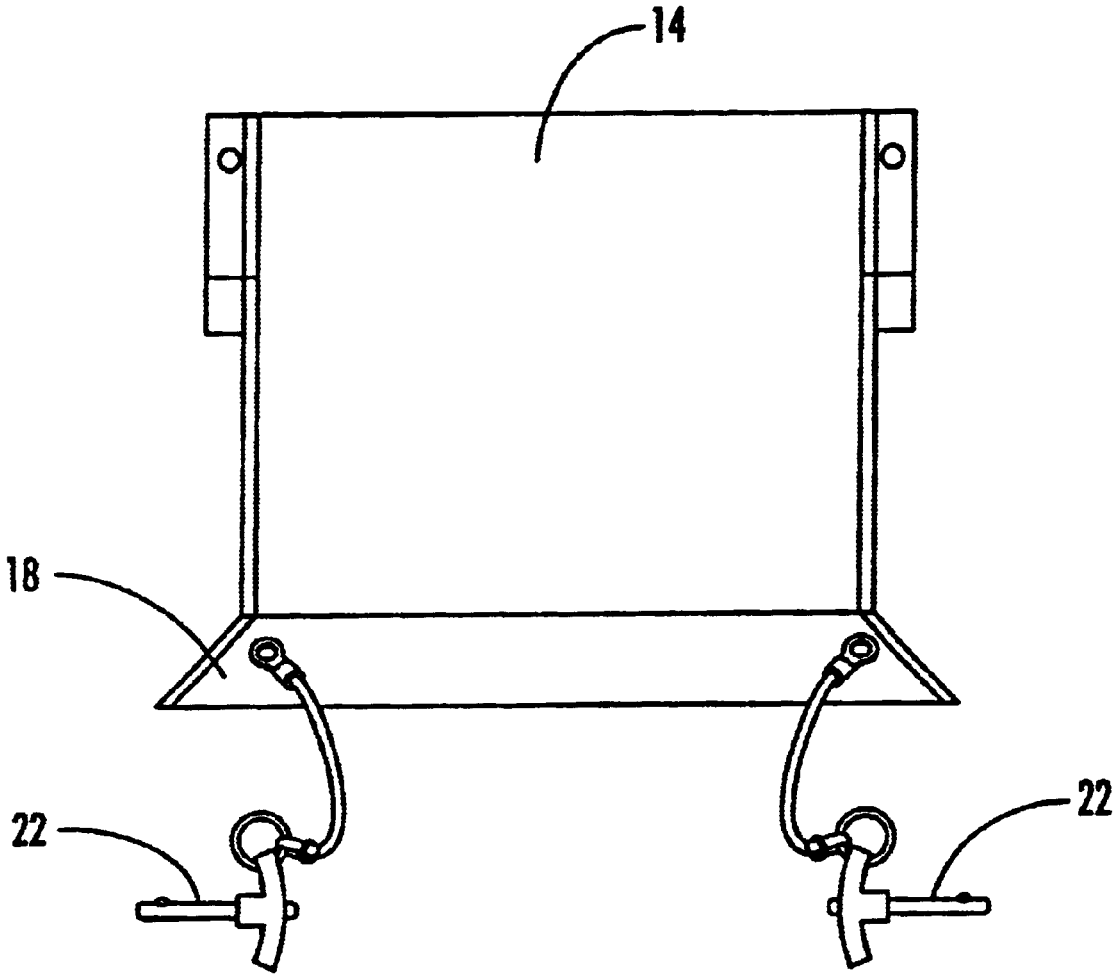
FIG. 5 is another front view of the feed chute housing shown in FIG. 3.

Referring to FIG. 2, one embodiment of the present invention of an ammunition feed assembly 10 is shown connected to an Avenger weapon system 12. The feed assembly 10 includes a feed chute housing 14 (not shown in FIG. 2, but see FIGS. 3–5) and an ammunition support bracket 16. The feed chute housing 14 is a hollow rectangular-shaped structure and includes a flanged opening 18 on one end. The other end of the feed chute housing 14 includes a pair of housing openings 20 for removable connecting the feed chute housing 14 to the weapon system 12 using a pair of quick release pins 22 (see FIG. 5).

Figure 6:
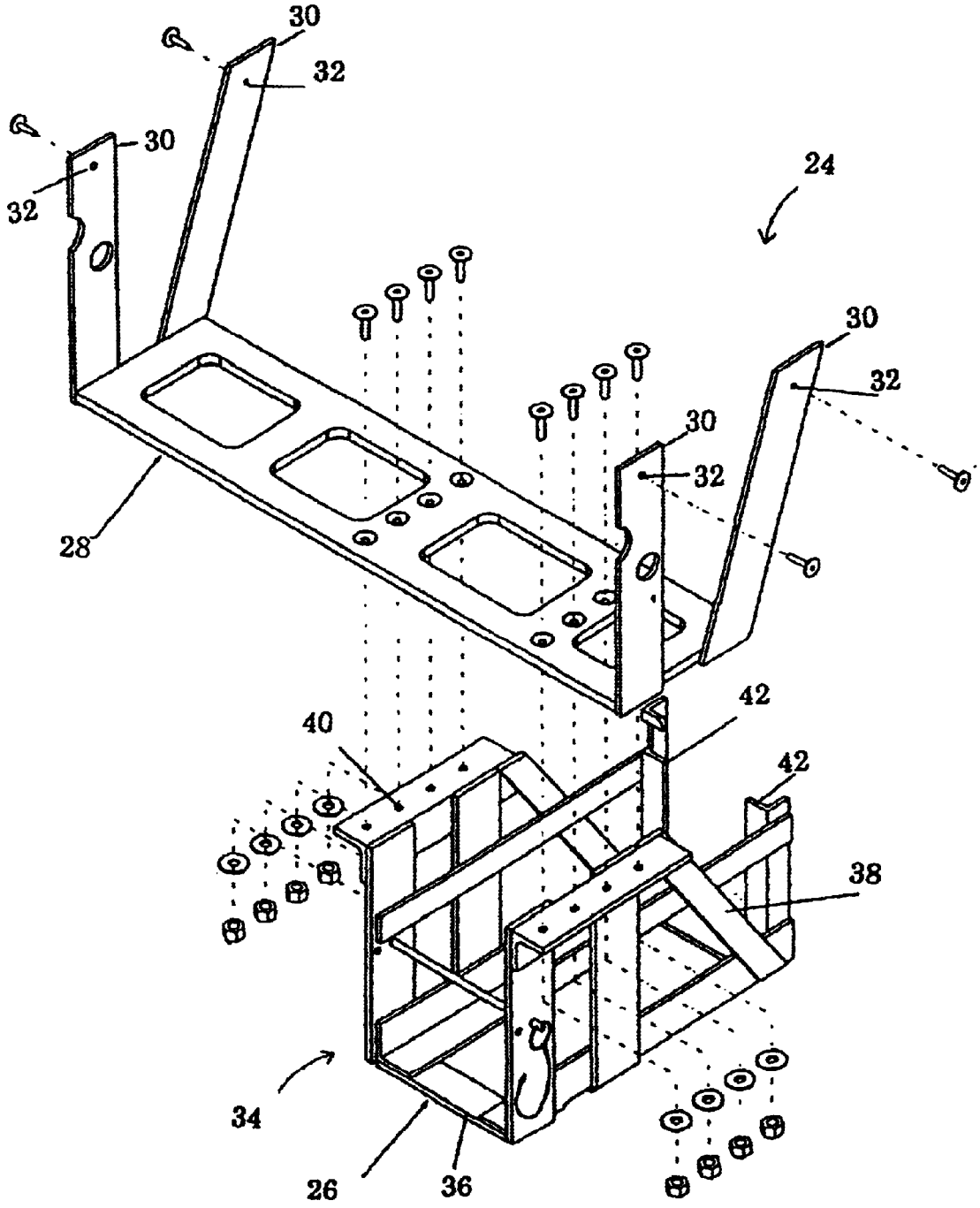
FIG. 6 is an exploded perspective view of one embodiment of the support bracket of the present invention.
Figure 7:
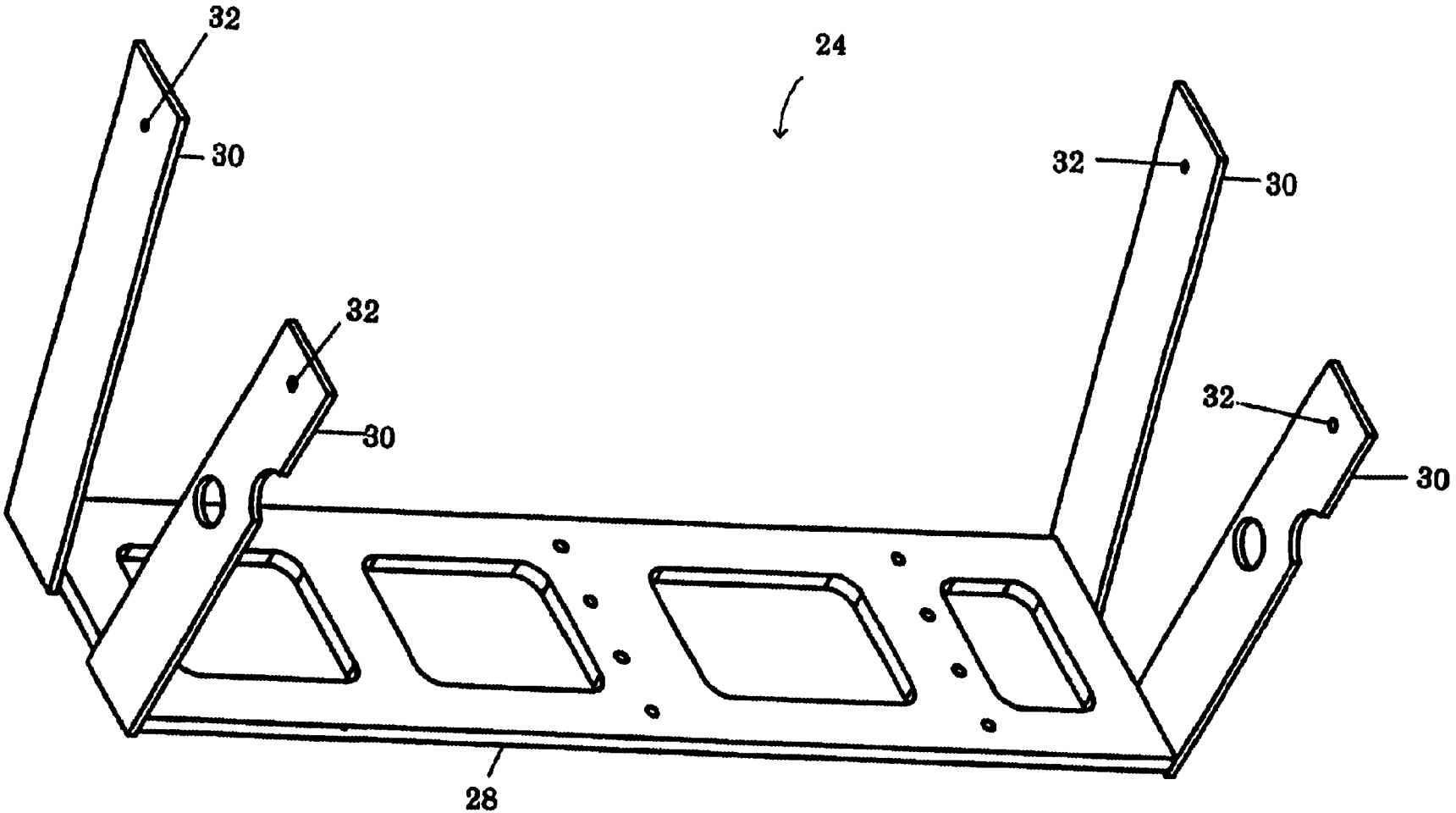
FIG. 7 is a perspective view of the mounting portion of the support bracket shown in FIG. 6.
Figure 8:
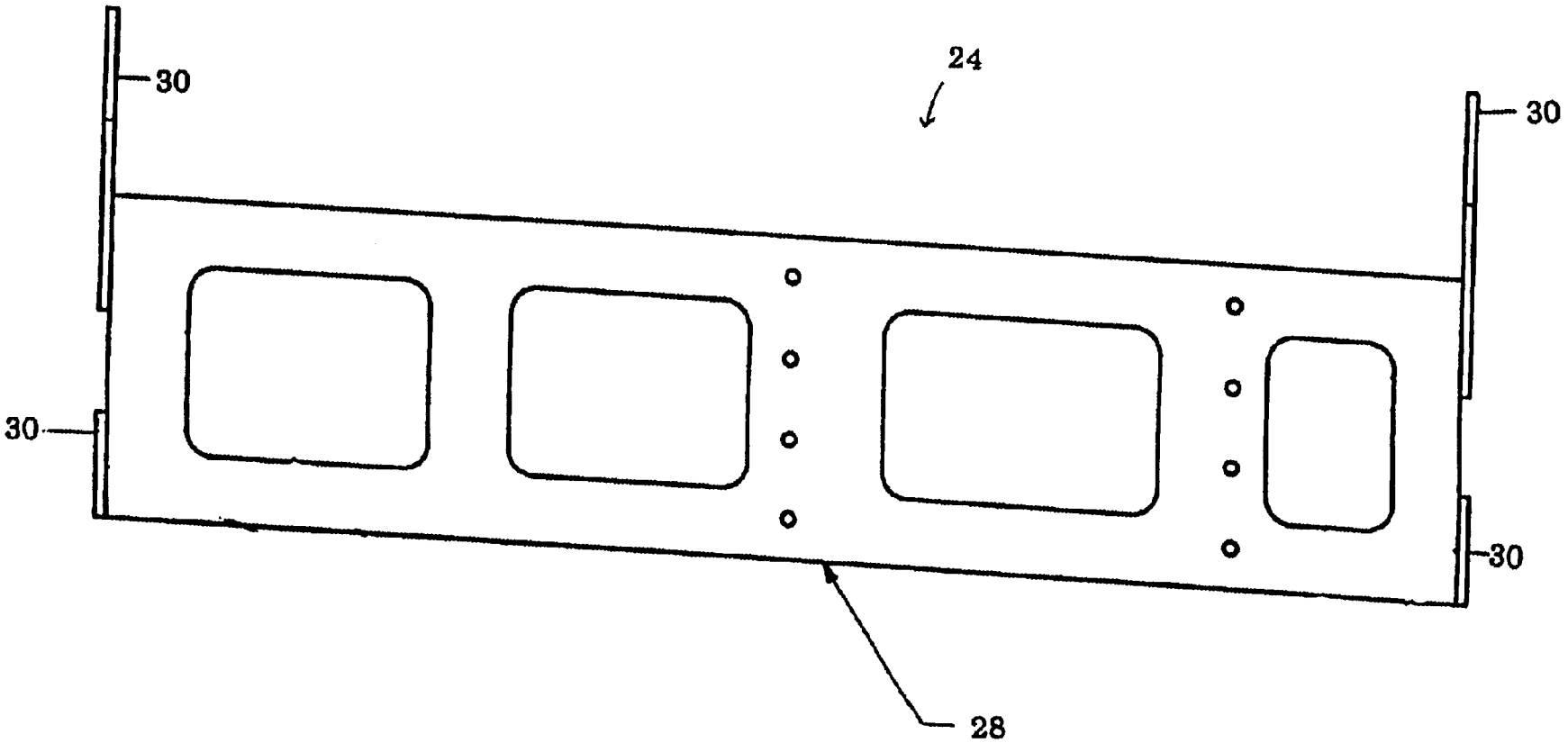
FIG. 8 is a top view of the mounting portion of the support bracket shown in FIG. 6.
Figure 9:
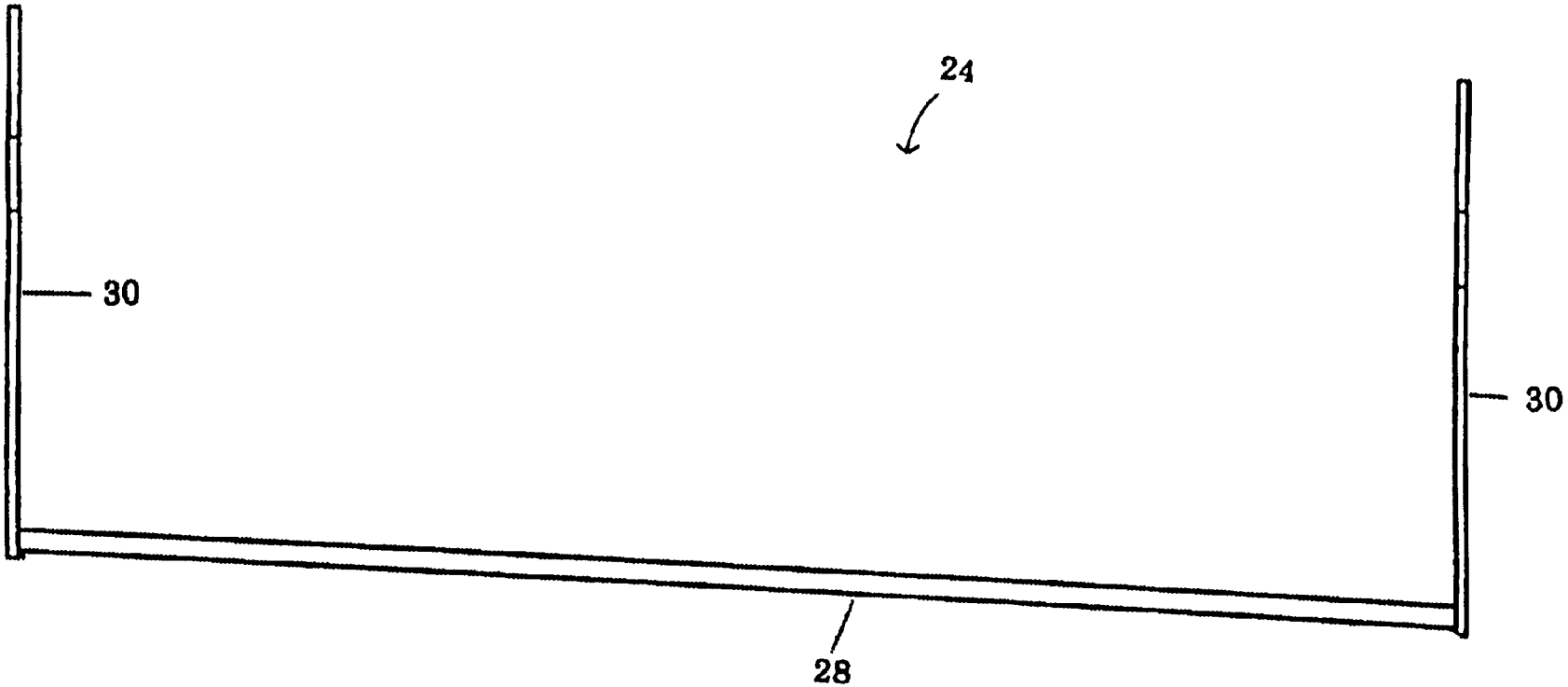
FIG. 9 is a front view of the mounting portion of the support bracket shown in FIG. 6.
Figure 10:
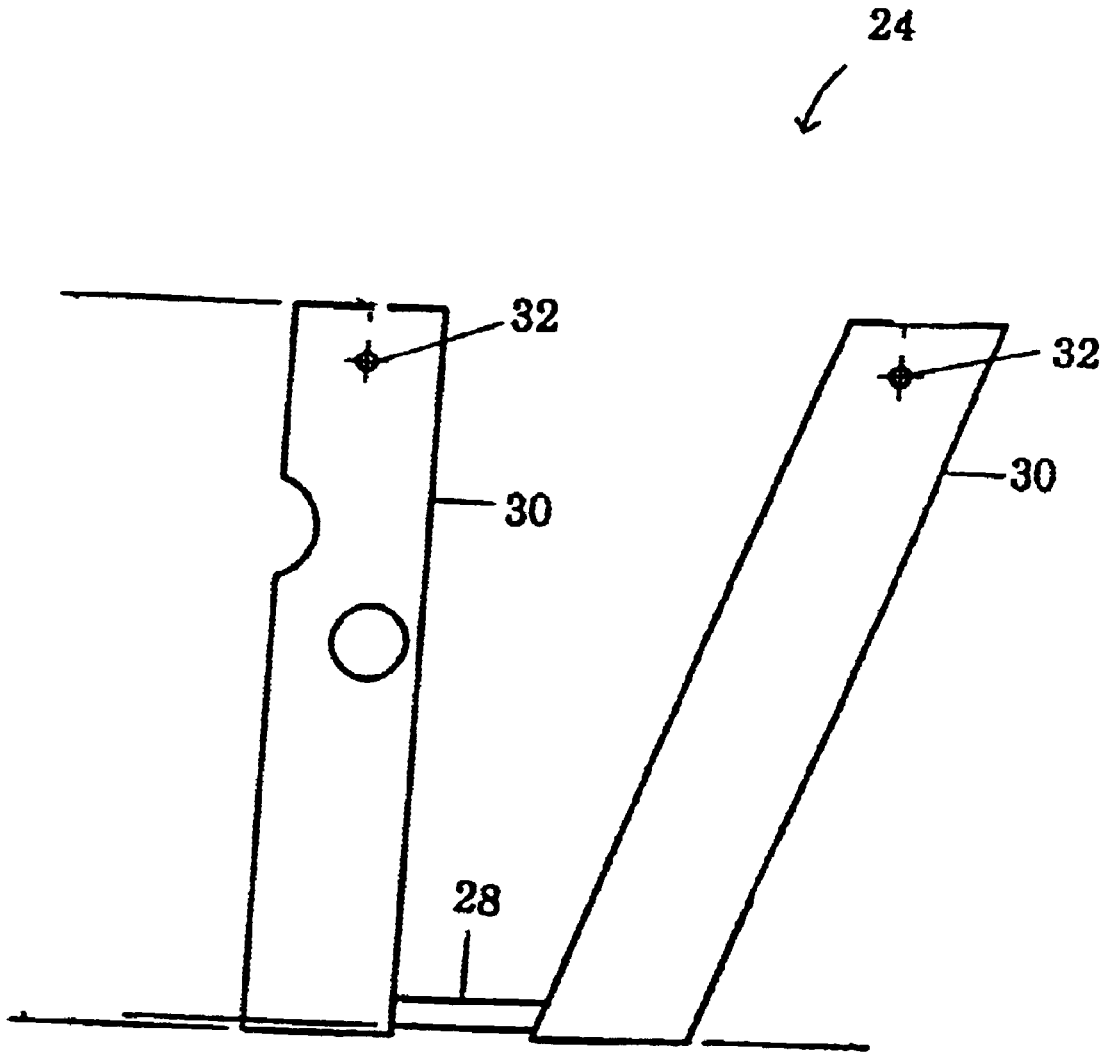
FIG. 10 is a side view of the mounting portion of the support bracket shown in FIG. 6.
Figure 11:
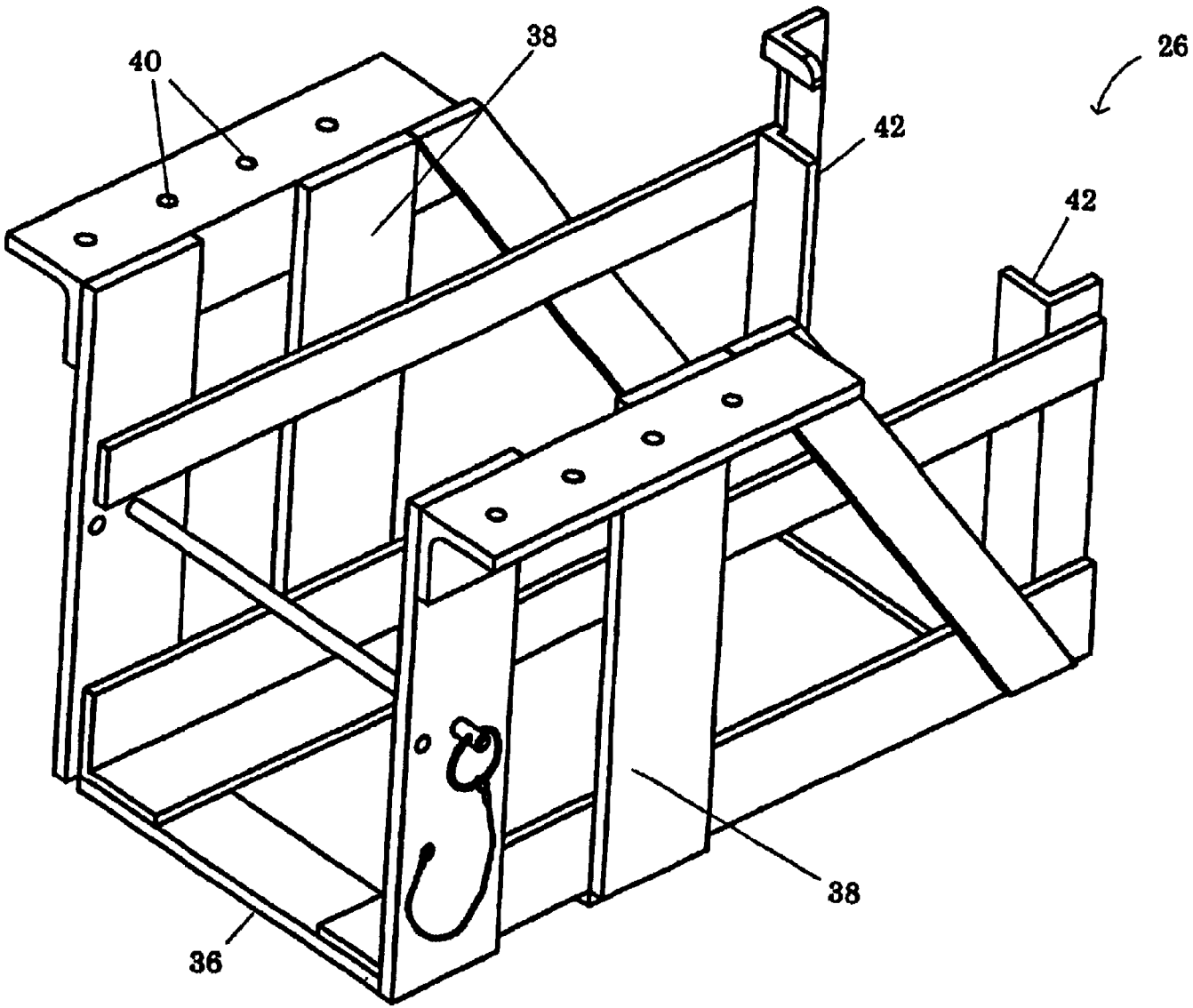
FIG. 11 is a perspective view of the ammunition support portion of the support bracket shown in FIG. 6.
Figure 12:
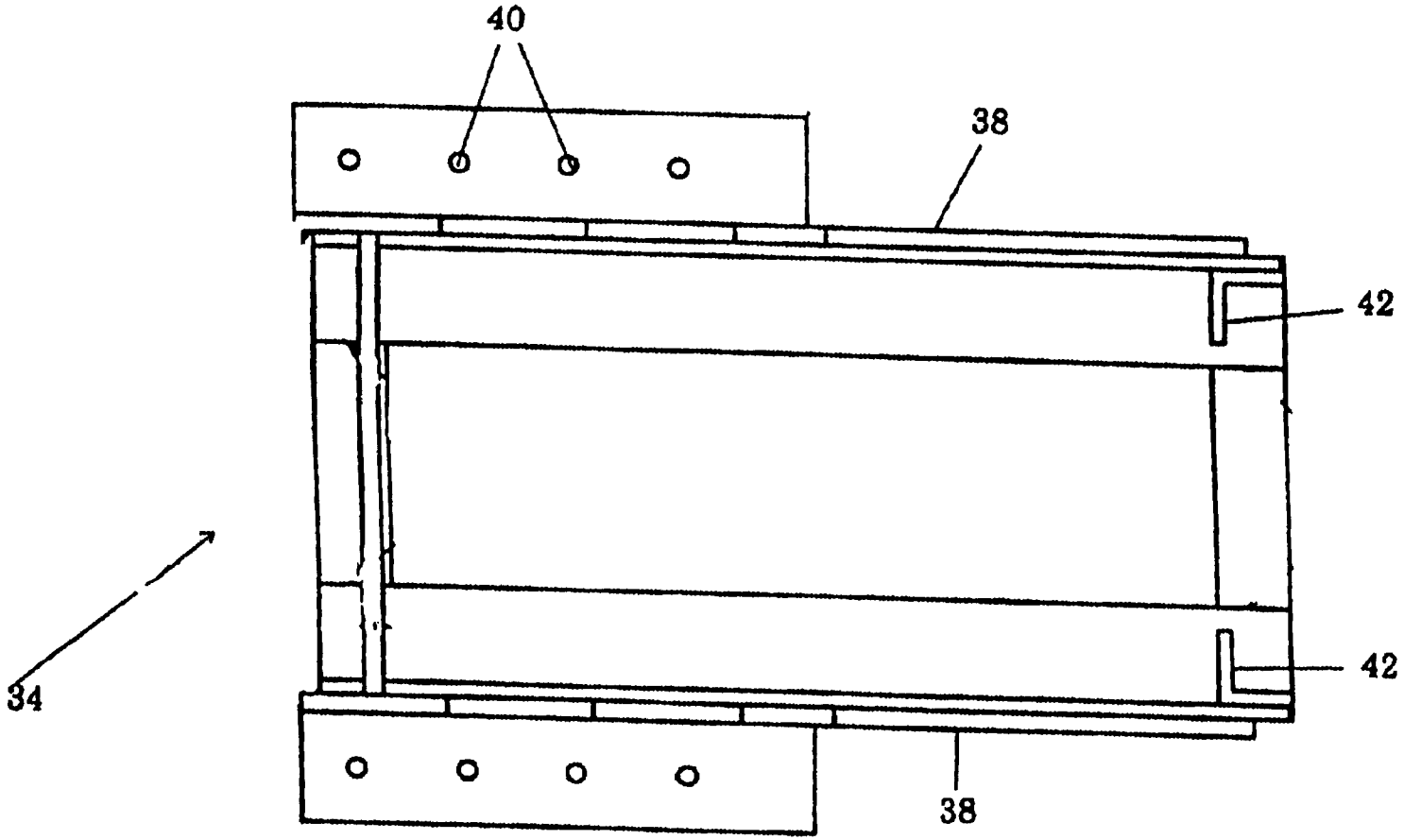
FIG. 12 is a top view of the ammunition support portion of the support bracket shown in FIG. 6.
Figure 13:
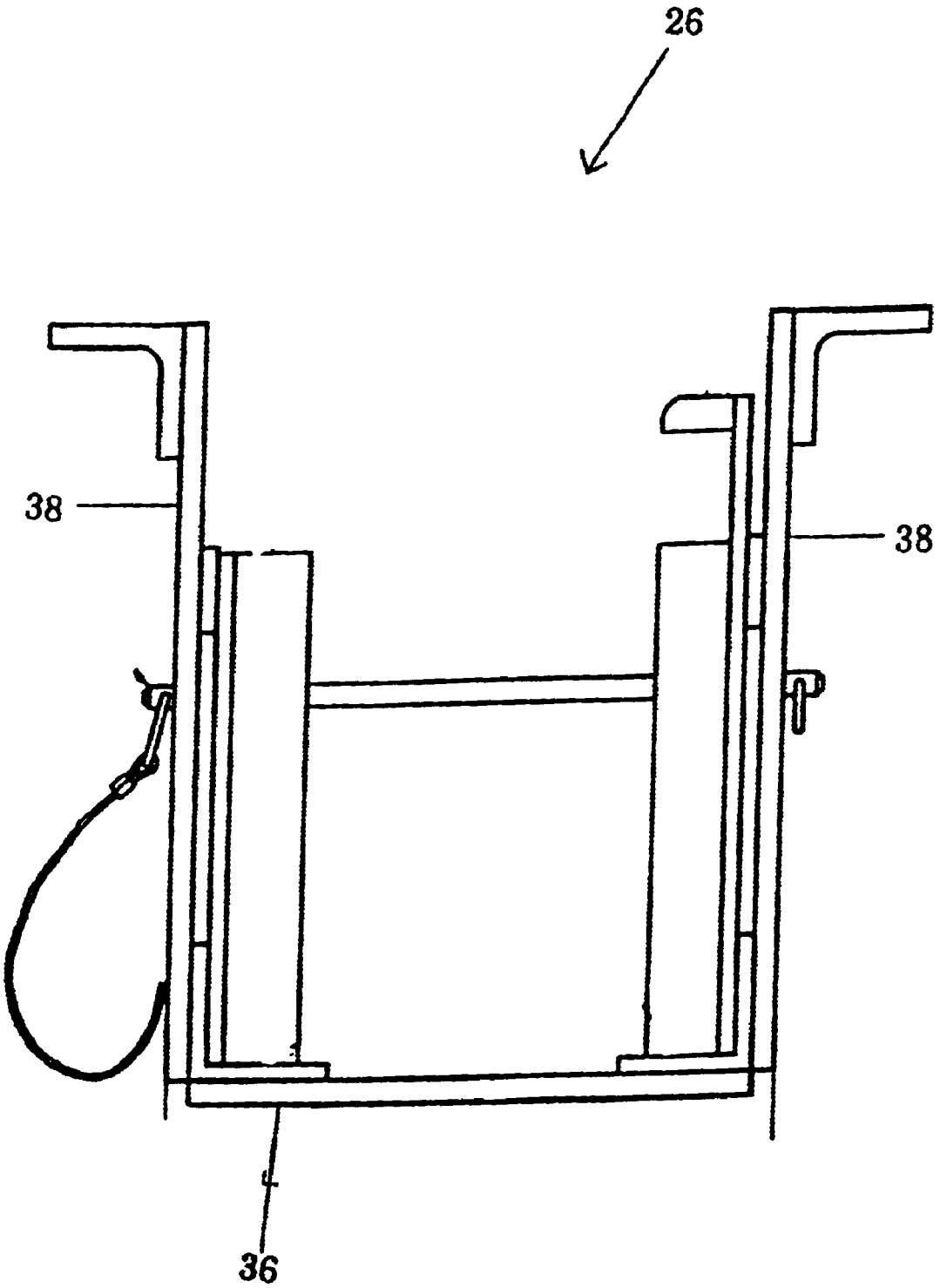
FIG. 13 is a front view of the ammunition support portion of the support bracket shown in FIG. 6.
Figure 14:
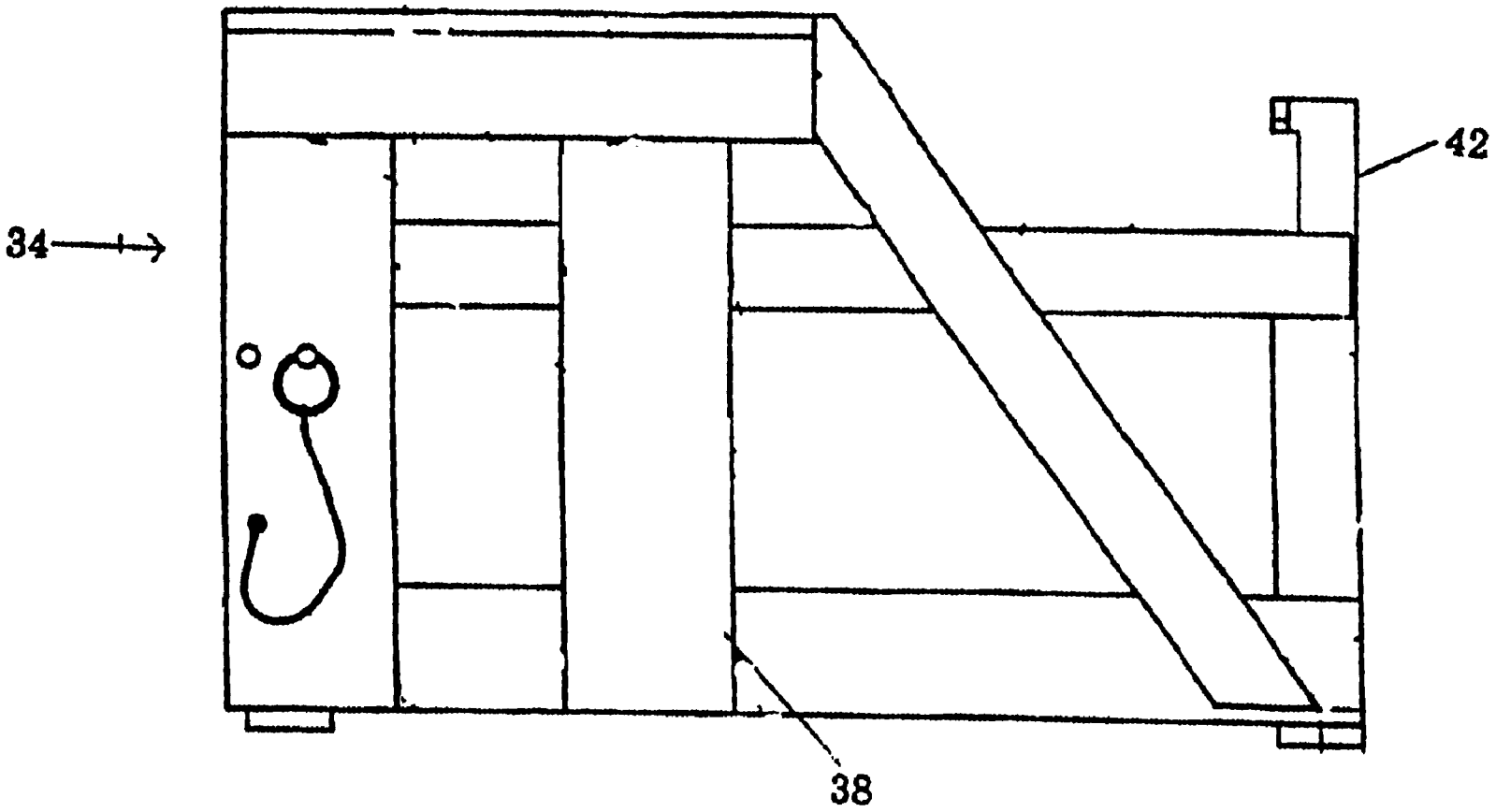
FIG. 14 is a side view of the ammunition support portion of the support bracket shown in FIG. 6.

Referring to FIG. 6, the support bracket 16 includes a mounting portion 24 and an ammunition support portion 26. The mounting portion 24 (see also FIGS. 7–10) includes a flat rectangular portion 28 with a pair of arms 30 connected on each end. The arms 30 each include bracket openings 32, which are used to connect the mounting portion 24 of the support bracket 16 to the weapon system 12.

Referring to FIGS. 6 and 11–14, the ammunition support portion 26 includes an open front end 34 formed by a flat base 36 and side walls 38. A top portion of each of the side walls 38 includes wall openings 40, which are used to connect the side walls 38 to the mounting portion 24. The support portion 26 also includes a back wall 42, which prevents an ammunition box 44 (see FIG. 2) inserted into the support portion 26 through the open front end 34 from sliding out of the support portion 26.

Figure 1:
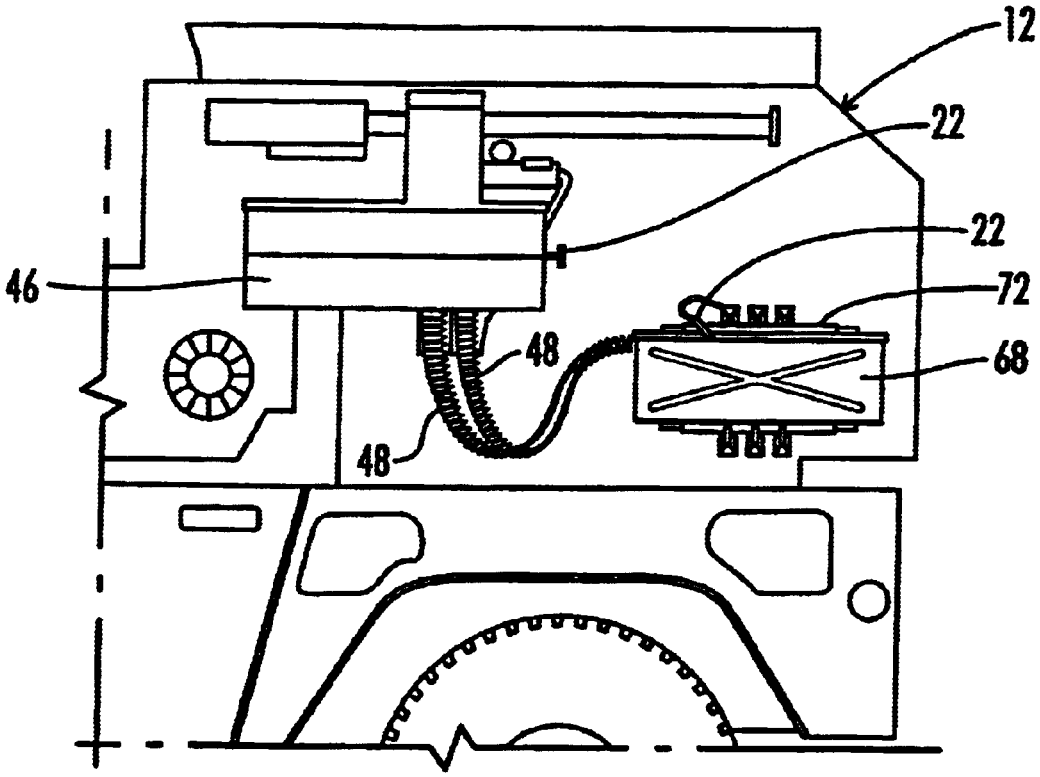
FIG. 1 (Prior Art)
FIG. 1 is a side view of an Avenger weapon system including a prior art ammunition feed assembly.

The ammunition feed assembly 10 of the present invention may be installed on the weapon system 12 in the following manner. First, a brass catcher 46 (see FIG. 1) is removed from the weapon system 12 by removing quick release pins 22. Next, a flexible feed chute 48 is removed from the weapon system 12 by depressing two side clips (not shown) on both ends of the flexible feed chute 48. A brass catcher support bracket (not shown) is then disconnected from the weapon system 12 by removing four Phillip slot/hex head screws (not shown).

The feed chute housing 14 is connected to an ammunition guide (not shown) using quick release pins. Next, the support bracket 16 is connected to the weapon system 12 by aligning the bracket openings 32 of the support bracket 16 with brass catcher bracket openings (not shown) of the brass catcher support bracket (not shown) and connecting both to the weapon system 12 using the four screws. The brass catcher 46 is then reconnected to the weapon system 12 using the quick release pins 22.

Continuing, ammunition box 44 (see FIG. 2), with its lid removed, is inserted into the ammunition support portion 26 and secured in place using an ammunition box pin 60 and an ammunition box clip 62. Ammunition 64 (not shown) is fed out of the ammunition box 44, through the feed chute housing 14 and the ammunition guide (not shown), and into a weapon 66.

Referring again to FIGS. 1 and 2, an existing ammunition box 68 used with the prior art ammunition feed assembly shown in FIG. 1 is replaced with an extra ammunition storage tray 70. The existing ammunition box 68 is disconnected from the weapon system 12 by removing quick release pins 22 and sliding the box 68 to the right off of tracks 72. The storage tray 70 is then connected to the weapon system 12 by sliding the tray 70 into the tracks 72 and re-inserting the quick release pins 22. Ammunition boxes 44 are held in place on the storage tray 72 using ammunition pins 60 and ammunition clips 62.

Thus, although there have been described particular embodiments of the present invention of a new and useful Weapon System Ammunition Feed Assembly, it is not intended that such references be construed as limitations upon the scope of this invention except as set forth in the following claims.

The invention claimed is:

1. An ammunition feed assembly for a weapon on a weapon system, comprising:

a feed chute housing for guiding ammunition into the machine gun, the housing adapted to be detachably connected to the weapon system using quick release pins, the feed chute housing including first and second flanges and a flanged portion for guiding ammunition into the housing, each flange including an opening adapted to receive one of the quick release pins; and a support structure adapted to be connected to the weapon system for supporting ammunition approximately adjacent to the feed chute housing.

2. The feed assembly of claim 1, wherein the feed chute housing includes a connecting mechanism on a first end for removably connecting the housing to the weapon system and a flanged opening for guiding ammunition into the housing on a second end.

3. The feed assembly of claim 2, wherein the support structure includes a mounting portion for connecting the support structure to the weapon system, the mounting portion including a flat rectangular portion with a pair of arms connected on both ends.

4. The feed assembly of claim 3, wherein the support structure includes an ammunition support portion for supporting ammunition, the support portion including an open front end formed by a flat base connected to a pair of side walls, the support portion further including a pin connected between the side walls across the open front end and a back wall connected to the side walls for preventing an ammunition box inserted into the ammunition support portion from sliding out of the support portion.

5. The feed assembly of claim 4, further comprising a storage tray connected to the weapon system for storing extra ammunition boxes.

6. An ammunition feed assembly for a weapon system having a weapon, comprising:

a feed chute housing adapted to be detachably connected to the weapon system for guiding ammunition into the weapon, and a support structure adapted to be connected to the weapon system for supporting ammunition adjacent to the feed chute housing, the support structure including a mounting portion for connecting the support structure to the weapon system and an ammunition support portion for supporting ammunition, the mounting portion including a flat rectangular portion, a first pair of arms connected substantially perpendicularly to and extending outward from the flat rectangular portion, and a second pair of arms connected to and extending outward away from the flat rectangular portion at an angle with respect to the first pair of arms.

7. The feed assembly of claim 6, wherein the ammunition support portion includes:

a base that includes two parallel L-shaped base pieces and two parallel elongated base pieces, all connected together to form a rectangular shape;

two side walls connected to the base, each side wall including two parallel, vertical elongated side pieces, an L-shaped horizontal top piece, a slanted elongated side piece, and a horizontal elongated side piece; and a back that includes two parallel L-shaped back pieces.

8. The feed assembly of claim 7, further comprising a storage tray connected to the weapon system for storing extra ammunition boxes.

9. A method of fitting a weapon system with an ammunition feed assembly, the ammunition feed assembly including a feed chute housing and an ammunition support bracket, the weapon system including a weapon, comprising the steps of:

connecting the feed chute housing to the weapon system using quick release pins;

connecting the ammunition support bracket to the weapon system, the ammunition support bracket including an ammunition support portion;

connecting the brass catcher to the weapon system using quick release pins;

inserting an ammunition box into the ammunition support portion; and securing the ammunition box in place by connecting an ammunition box pin and an ammunition box clip to the ammunition support portion.

10. The method of claim 9, wherein the step of connecting the feed chute housing to the weapon system includes the step of removably connecting the feed chute housing to the weapon system.

11. The method of claim 10, wherein the step of connecting the feed chute housing to the weapon system includes the step of connecting the feed chute housing to an ammunition guide adjacent to a weapon mounted on the weapon system.

12. The method of claim 11, further comprising the step of installing an ammunition storage tray on the system.

13. The method of claim 12, further comprising the steps of inserting an ammunition box into the ammunition support portion of the support bracket and feeding ammunition out of the ammunition box, through the feed chute housing and the ammunition guide, and into the weapon mounted on the weapon system.

* * * * *